US007510812B2

(12) United States Patent
Earley et al.

(10) Patent No.: US 7,510,812 B2
(45) Date of Patent: Mar. 31, 2009

(54) TONER FORMULATIONS CONTAINING EXTRA PARTICULATE ADDITIVES

(75) Inventors: John Earley, Boulder, CO (US); Rick Jones, Berthoud, CO (US); George Marshall, Boulder, CO (US); John Olson, Boulder County, CO (US)

(73) Assignee: Lexmark International, Inc., Lexington, KY (US)

( * ) Notice: Subject to any disclaimer, the term of this patent is extended or adjusted under 35 U.S.C. 154(b) by 393 days.

(21) Appl. No.: 11/391,121

(22) Filed: Mar. 28, 2006

(65) Prior Publication Data

US 2007/0231728 A1 Oct. 4, 2007

(51) Int. Cl.
*G03G 9/08* (2006.01)

(52) U.S. Cl. ..... 430/108.7; 430/110.1; 430/111.4

(58) Field of Classification Search ..... 430/108.7, 430/110.1, 111.4, 108.6
See application file for complete search history.

(56) References Cited

U.S. PATENT DOCUMENTS 6,312,862 B1 * 11/2001 Okado et al. ..... 430/110.1
6,503,677 B1 1/2003 Gutman et al. ..... 430/108.3
6,531,254 B1 3/2003 Bedells et al. ..... 430/109.3
6,531,256 B1 3/2003 Bedells et al. ..... 430/137.14
6,555,281 B1 4/2003 Nozawa et al. ..... 430/108.6
2004/0137349 A1 * 7/2004 Horikoshi et al. ..... 430/108.6
2006/0204878 A1 * 9/2006 Anno et al. ..... 430/108.6

OTHER PUBLICATIONS

Degussa Product Information: Hydrophobic Fumed Silica: Aerosil® R812 (Jun. 2004—2 pgs), Aerosil® RX50 (Jul. 2005- 2 pgs) & Aerosil® NY50 (Jul. 2005—2 pgs); www.aerosil.com.
Oki Electric Industry Co., Ltd., Oki Technical Review (No. 161, vol. 64, Aug. 1998) "Encapsulated Toner Fixed By Low Temperature"; http://www.oki.com/en/otr/html/nf/otr-161-15-2.html (11 pgs).
Wacker-Chemie GmbH: HDK® Wacker Silicones: Perfect Toners Hide A Secret: HDK® —Pyrogenic Silica (23 pgs).
Wacker-Chemie GmbH: HDK® Wacker Silicones: Perfect Toners Hide A Secret: HDK® —Pyrogenic Silica (23 pgs), Aug. 1972.

* cited by examiner

*Primary Examiner*—John L Goodrow
(74) *Attorney, Agent, or Firm*—Steven S. Grossman

(57) ABSTRACT

The present invention relates to toner compositions containing extra particulate additives. The additives may include a mixture of silica particles having differing BET surface areas and may include an acicular inorganic oxide. The control of such additives may be relied upon to control toner performance with respect to functional performance considerations such as filming and/or overall print quality.

12 Claims, 8 Drawing Sheets

TONER FORMULATIONS CONTAINING EXTRA PARTICULATE ADDITIVES

FIELD OF INVENTION

The present invention relates to the use of extra particulate additives (EPA) in toner compositions for an image forming apparatus. The EPA may include a mixture of inorganic particles which may be present at particular size ranges and in particular concentrations. The use of such a mixture may then improve toner performance such as resistance to filming and overall print quality. The toner composition may be a chemically prepared toner wherein the toner may have a softening temperature suitable for use with relatively lower energy fusers.

BACKGROUND

Toner compositions may be used in electrophotographic devices that form a latent electrostatic image on a drum. The latent image may then be developed into a visible image via the toner composition, which may then be transferred onto a suitable substrate. Once transferred, the toner composition may then be fused to the substrate by a heat fixing apparatus, such as a fuser. The electrophotographic devices may include printers, copiers, faxes and combinations thereof.

The toner compositions may generally include polymeric binder resin, colorants, internal additives and external additives. Various functional requirements, such as release properties, powder flow and transfer efficiency of the toner particles may be satisfied by adjusting the type and loading of the various additives incorporated into or on the binder resins or colorants. The toner particles may be formed through the polymerization of resin via processes including bulk, suspension, emulsion and combinations thereof. The resins may be aggregated with colorants or other additives. Once aggregated, the polymerized resins, colorants or other additives may be coalesced.

SUMMARY

An aspect of the present invention relates to a toner for an image forming apparatus. The toner may be a chemically processed toner which may include a resin having a particle size in the range of 1 micron to 25 microns and extra particulate additives. The extra particulate additives may include a mixture of silica particles indicating different BET surface areas which mixture be combined with an acicular inorganic oxide. Another aspect of the present invention relates to a method of controlling filming of a CPT toner by adjustment of the type and concentration of one or more of the extra particulate additives within a given toner composition.

BRIEF DESCRIPTION OF THE DRAWINGS

The detailed description below may be better understood with reference to the accompanying figures which are provided for illustrative purposes and are not to be considered as limiting any aspect of the invention.

DETAILED DESCRIPTION

The present invention relates to a toner formulation for use in an image forming device. The toner may be modified by providing various extra particulate additives, such as inorganic additives. The unique combination of the extra particulate additives may be optimized to increase overall print quality and to reduce filming or deposits on components within a given image forming device.

The toner particles may be advantageously prepared by chemical methods, and in particular an emulsion aggregation procedure, which generally provides resin, colorant and other additives. More specifically, the toner particles may be prepared via the steps of initially preparing a polymer latex from ethylene type monomers, in the presence of an ionic type surfactant, such as an anionic surfactant having terminal carboxylate (—$COO^-$) functionality. In addition, monomers, such as methacrylic acid, may be added to the polymer latex, which may polymerize and assist in emulsion stability.

The polymer latex so formed may be prepared at a desired molecular weight distribution and may, e.g., contain both relatively low and relatively high molecular weight fractions, as well as a number of weight fractions between to thereby provide a bimodal or multi-modal molecular weight distribution. The polymer latex so formed may also be prepared and rely upon resins having a desired softening point to accommodate a given electrophotographic device, and in particular, certain fuser temperature requirements. In such a manner more than one resin may be provided, wherein each resin may exhibit relatively dissimilar softening points or softening point ranges. This may then better define a broader and more acceptable fuser operating window for a given toner composition.

For example, the toner resins may have softening temperatures that fall within the range of about 90-130° C. including all values and increments therebetween. For example the resins may soften between about 100-120° C. Accordingly, at such temperatures, the resins may soften a sufficient amount from the solid state such that they may achieve a desired amount of flow in order to be effectively fused to any given sample of media.

Figure 1:
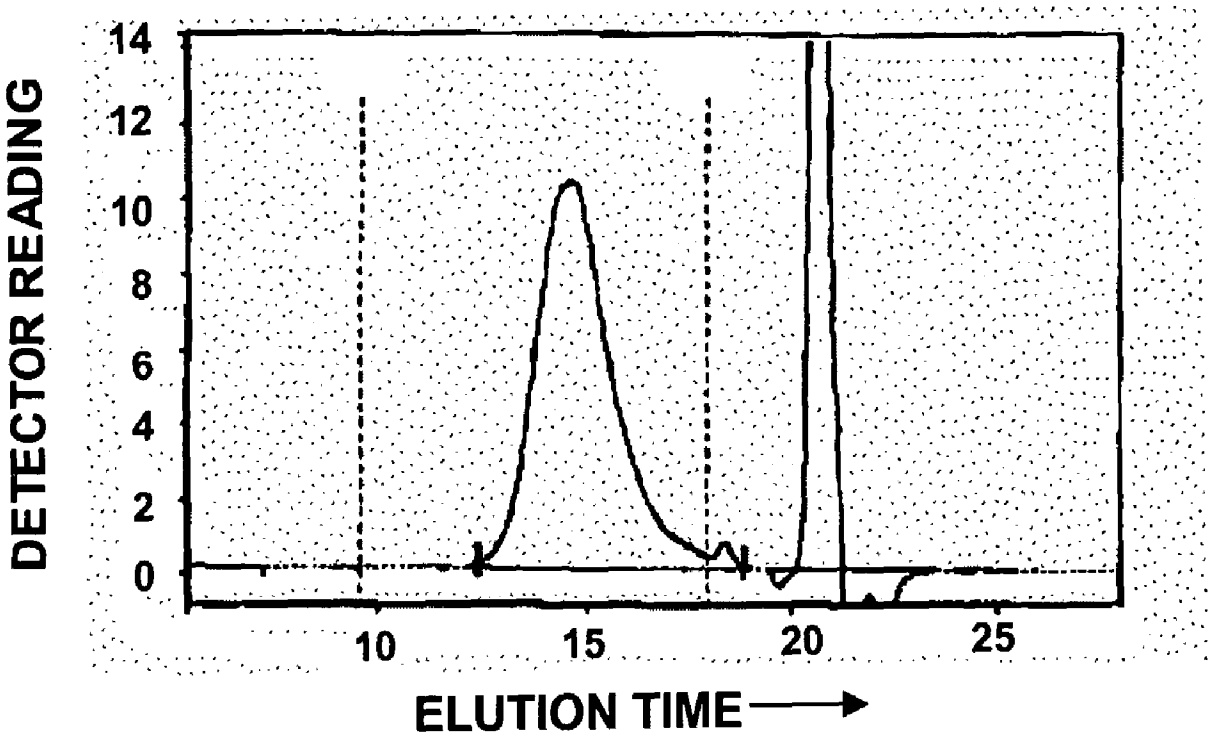
FIG. 1 is a chromatogram of an exemplary low molecular weight resin that may be used the chemically processed toner composition.
Figure 2:
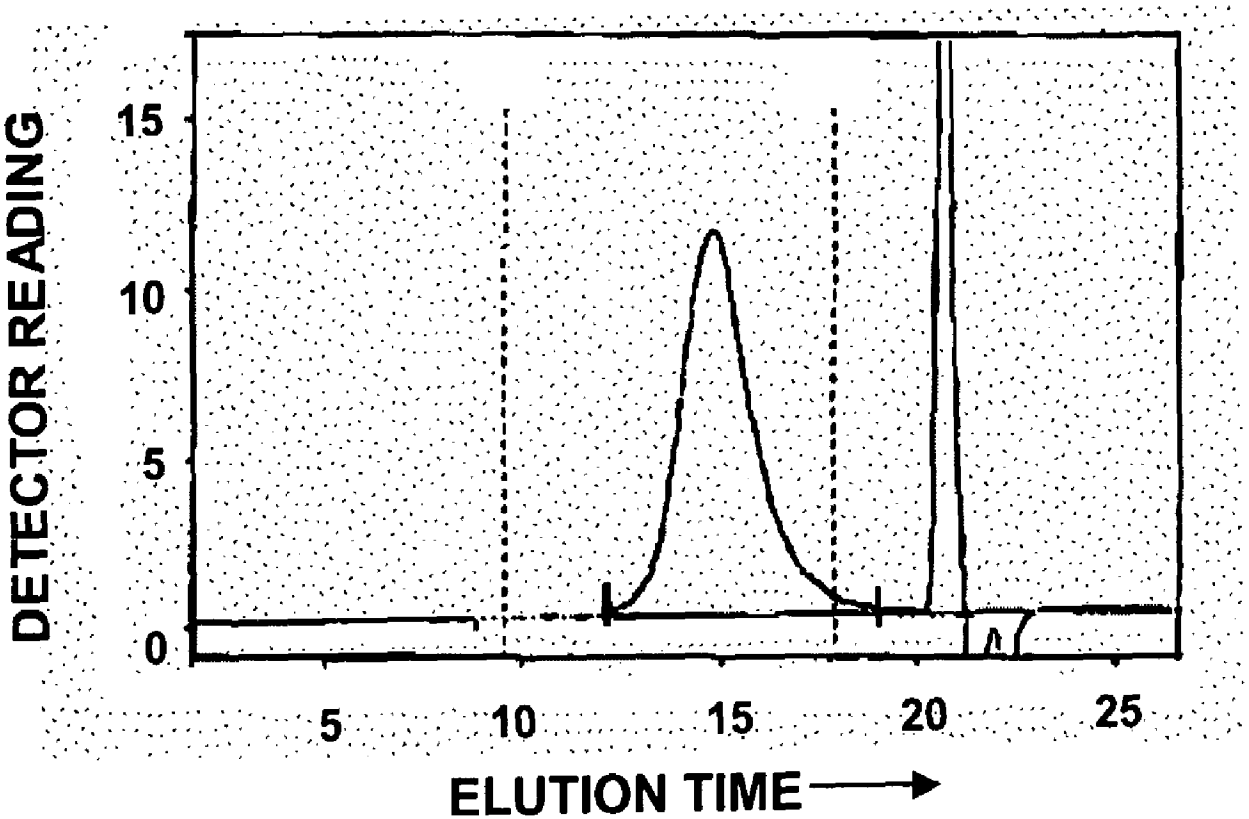
FIG. 2 is a chromatogram of another exemplary low molecular weight resin that may be used the chemically processed toner composition.

The resins suitable for use in the toner compositions herein may also be characterized by Gel Permeation Chromatography (GPC). As shown in FIGS. 1-4, GPC chromatograms are provided that illustrate the values and distribution of molecular weights of the resins that may be employed herein. For example, as shown in FIG. 1, the GPC curve indicates that the resin may be a relatively low molecular weight resin that has the following calibrated values: Mw=20,729; Mz=37,174 and Mn=6167. The peak MW for such resin may occur at about 18,500. The polydispersity index or PDI, which reflects the value of Mw/Mn is about 3.36. As shown in FIG. 2, another suitable low molecular resin may exhibit a GPC curve that indicates the following values: Mw=17,185; Mz=30,624 and Mn=5397 with a peak MW of 15,327 and a PDI of about 3.18.

Therefore, either one or both of such relatively low molecular weight resins may be employed, which therefore identifies that the relatively low molecular weight resin may have a Mw value of between about 10,000-30,000 and with a PDI of between about 1-7. In addition, the GPC curves of the relatively low molecular weight resin, although not illustrated, may itself be bimodal or multi-modal. Furthermore, in the context of the present invention, the relatively low molecular weight resin may account for the majority of the polymeric resin present, which may be understood as greater than 50% by weight (wt), and in the range of about 50.01% -99.99% (wt). For example, the relatively low MW resin may be present in the range of about 70-90% (wt).

Figure 3:
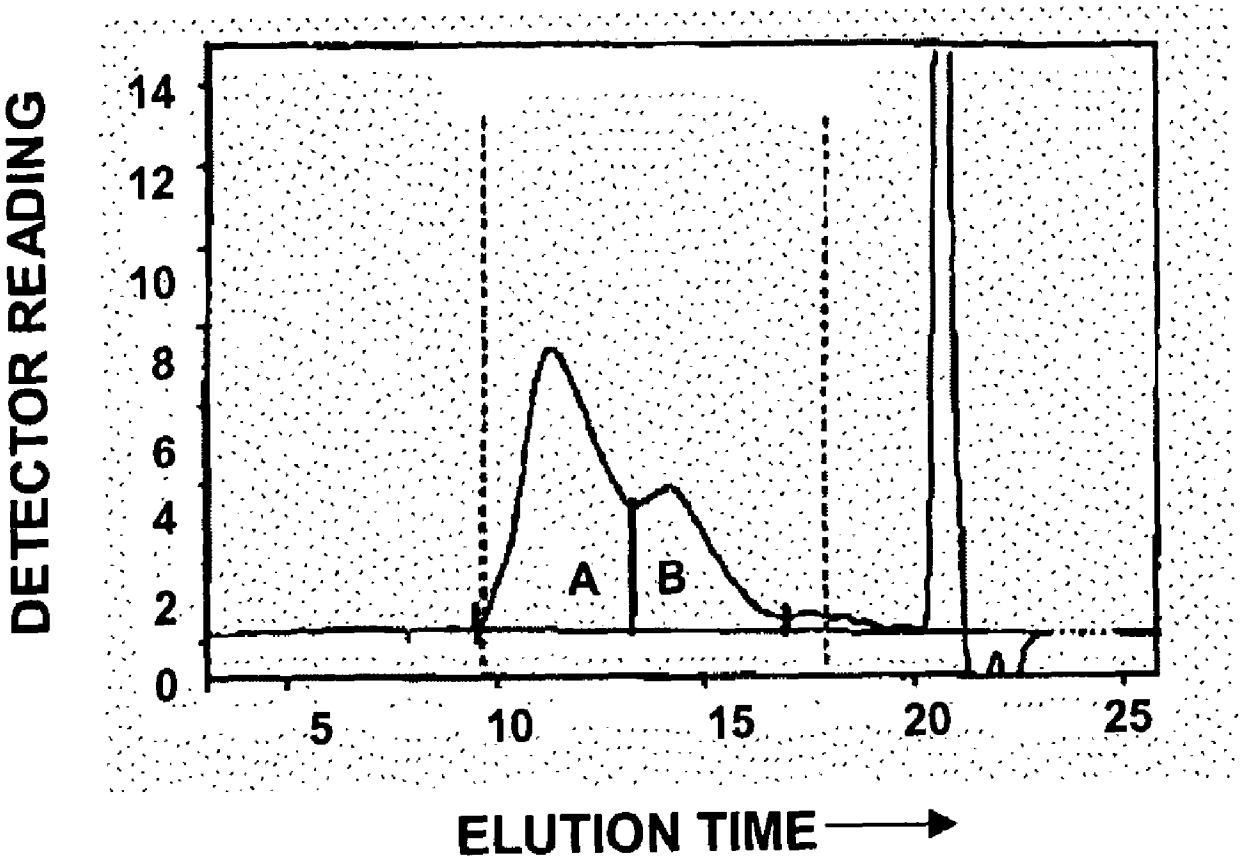
FIG. 3 is a chromatogram of an exemplary high molecular weight resin that may be used the chemically processed toner composition.

FIG. 3 provides a GPC chromatogram for exemplary resin herein that may be considered relatively high MW, which identifies the following values for the indicated variables:

| | Mw | Mz | Mn | Peak MW | PDI |
|---|---|---|---|---|---|
| Total | 469645 | 1560949 | 39352 | 608878 | 11.93 |
| Peak A | 683740 | 1591095 | 285249 | 608878 | 2.40 |
| Peak B | 26810 | 36756 | 14298 | 28544 | 1.66 |

Figure 4:
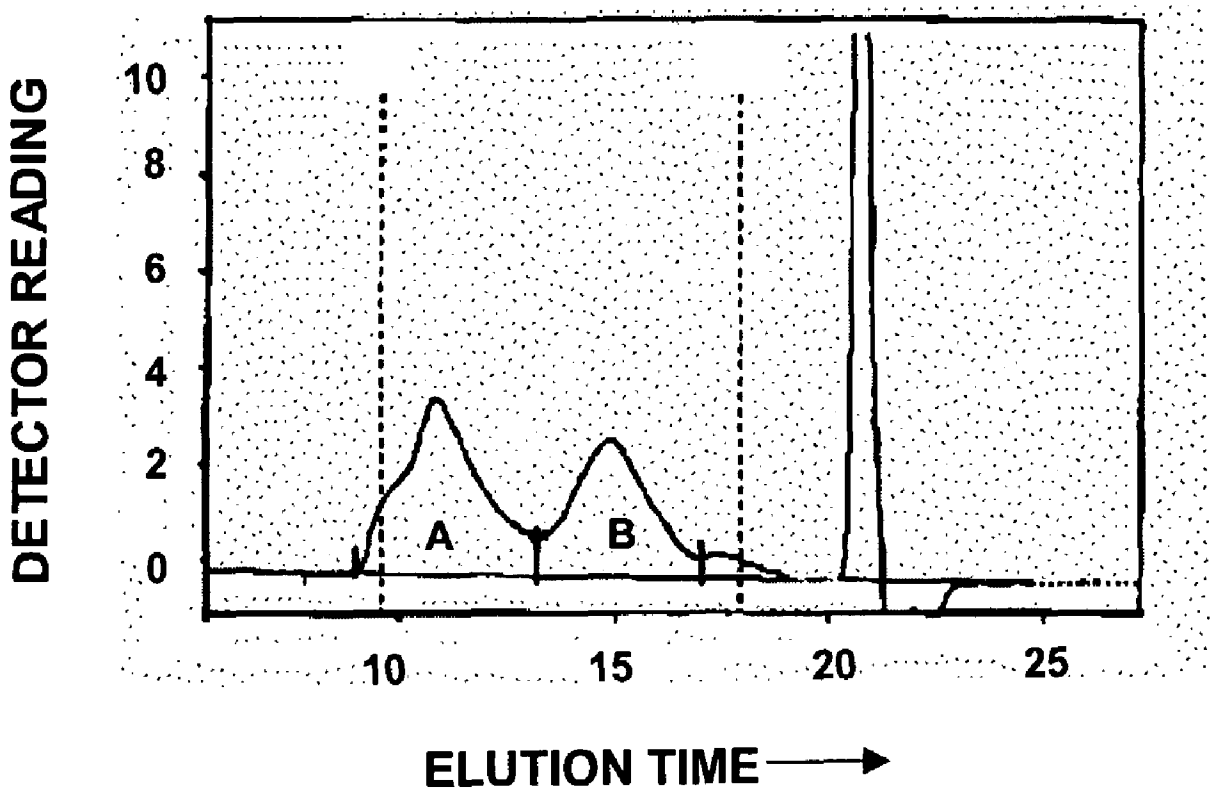
FIG. 4 is a chromatogram of another exemplary high molecular weight resin that may be used the chemically processed toner composition.

FIG. 4 provides a GPC chromatogram for yet another exemplary high MW resin which identifies the following values for the indicated variables:

| | Mw | Mz | Mn | Peak MW | PDI |
|---|---|---|---|---|---|
| Total | 955323 | 4428931 | 21544 | 1027064 | 44.34 |
| Peak A | 1683672 | 4467714 | 476566 | 1027064 | 3.53 |
| Peak B | 18701 | 315966 | 9699 | 14610 | 1.93 |

Accordingly, the relatively high MW resin herein may have a total Mw value for a bimodal sample that is greater than about 30,000, and may be in the range of between about 30,001-125,000. The total PDI may be greater than about 7, and may fall in the range of 7.1-75. In addition, the relatively high MW resin may be present as a relatively minor component in a mixture with relatively low MW resin, and may therefore be present at levels of less than 50% (wt), including all values and increments therein. For example, the relatively high MW resin may be present at a level of between 10-30% (wt). In addition, the relatively high MW resin may be selected such that it has, when heated by the fuser, an appropriate level of viscoelastic response or melt strength such that it may substantially or completely release from the fuser at the operating temperatures within a given electrophotographic device and provide acceptable print quality.

Pigments may then be milled in water along with a surfactant that has the same ionic charge as that employed for the polymer latex. Release agent (e.g. a wax or mixture of waxes) may also be prepared as an aqueous emulsion in the presence of a surfactant that assumes the same ionic charge as the surfactant employed in the polymer latex. Optionally, one may include a charge control agent.

The polymer latex, pigment latex and wax latex may then be mixed and the pH adjusted to cause flocculation. For example, in the case of anionic surfactants, acid may be added to adjust pH to neutrality. Flocculation therefore may result in the formation of a gel where an aggregated mixture may be formed with particles of about 1-2 μm in size.

Such mixture may then be heated to cause a drop in viscosity and the gel may collapse and relative loose (larger) aggregates, from about 1-25 μm may be formed, including all values and ranges therein. For example, the aggregates may have a particle size between 3 μm to about 15 μm, or between about 6 μm to 7 μm. In addition, the process may be configured such that at least about 80-99% of the particles fall within such size ranges, including all values and increments therein. Base may then be added to increase the pH and reionize the surfactant or one may add additional anionic surfactants. The temperature may then be raised to bring about coalescence of the particles, which then may be washed and dried. Coalescence is reference to fusion of all components.

The above procedure therefore offers flexibility in the selection of resin components and pigments (colorants) and it may be appreciated that a wide variety of surfactants (either anionic or cationic) may be employed. As noted, the process may rely upon pH to alter the charge on a surfactant to stabilize disperse particles, which may amount to deprotanating a cation or protonation of an anion.

As alluded to above, the resins contemplated herein may therefore include resins sourced from monomers having ethylenically unsaturated bonds that may be subject to free radical polymerization. The resins may therefore include homopolymers or copolymers based upon styrenes, acrylates, methacrylates, butylacrylates, butadiene, isoprene, acrylic acid, methacrylic acid, acrylonitrile, vinyls, etc. Other resins may also be contemplated such as condensation polymers, including polyamide and/or polyester resins, of a linear, branched or even crosslinked configuration. The resins may also be modified such that they contain functional groups (e.g. an ionic group) which may allow the resin to more directly disperse in an aqueous medium without the need for surfactants.

Where the polymeric resins are prepared via emulsion or suspension polymerization, initiators may include, for example, peroxides or persulfates. Water soluble initiators may be employed in the case of an emulsion polymerization and water insoluble initiators may be employed in the case of suspension polymerization.

The various pigments which may be included may produce cyan, black, yellow or magenta toner particle colors. The pigments, themselves may range in particle size between 10 nm and 2 μm, including all values and increments therebetween. The colorant may be included within a range of about 2 to 12% (wt), including all increments and values therebetween. Additional additives may also be incorporated into the toner particles such as charge control agents and release agents which may be incorporated into the colorant latex or polymer latex.

The release agent may be included in the toner composition at levels greater than 3.0% (wt), including all increments and ranges therein such as 4% (wt) to 15.0% (wt), 10% (wt), etc. The release agent may have a number average molecular weight (Mn) of greater than about 500. Moreover, the release agent may have a Mn of between about 501-20,000, including all values and increments therein.

Exemplary release agents may include one or more vegetable waxes, mineral waxes, petroleum waxes, carnauba wax or synthetic waxes such as hydrocarbon wax, paraffin, chemically modified waxes, etc. For example, for a given weight percent of release agent, the release agent may comprise a mixture of waxes.+In an exemplary embodiment, a hydrocarbon wax may be present between 20-99% of the release agent weight and a carnauba wax may be present between 1-80% of the release agent weight, including all increments and ranges therebetween.

The hydrocarbon wax may specifically be sourced as a "Fisher-Tropsch" wax. Accordingly, in an exemplary embodiment, the release agent may include a formulation that contains greater than 50% Fisher-Tropsch wax relative to the presence of carnauba wax. For example, a release agent formulation that contains about 80% Fisher-Tropsch wax and about 20% carnauba wax. In that sense, the invention herein contemplates a mixture of hydrocarbon (or relatively non-polar) wax in combination with wax substances that are relatively more polar, and are based upon esters of fatty acids, fatty alcohols, esterified fatty diols and hydroxylated fatty acids.

The release agent, in the form of a wax, may form wax domains within the toner particles and may therefore have a wax domain size within the toner particles. The mean particle domain size of the release agent may be in the range of about 0.10 μm to about 1.20 μm, including all values and increments therein. For example, the wax domain size may have a value of about 0.40 to 1.00 μm, or 0.50-0.90 μm, or the individual values of about 0.50 μm, 0.60 μm, etc. The release agent may also have a minimum wax domain size of about 0.01 μm and a maximum wax domain size of about 4.0 μm.

Such a domain size may be measured, for example, by embedding the release agent in a cured resin and cutting sections of about 250-300 nm using a diamond knife. Transmission electron microscopy (TEM) images then may be employed at 17,000 times magnification. The size of about 100 wax domains may then be measured using image analysis software (e.g. Zeiss KS300). Such a wax domain size may effect and advantageously define or influence the compatibility of the wax within a given continuous phase of resin polymer and in particular, resins having a specific melting point or melting point range.

The release agent (wax) may also have a crystalline phase as defined by a differential scanning calorimetry (DSC) peak melting point temperature of between about 75° C. to about 105° C. This may be understood at the peak in the melting endotherm of the wax within a toner composition (e.g. black, cyan, magenta or yellow) by a given DSC heating scan. Furthermore, the wax herein may have more than one crystalline form or size as defined by multiple peak melting points (i.e. a plurality of peaks) within the range of 75-105° C. In addition, the release agent (wax) may be characterized herein by a DSC onset melting temperature. This may correspond to the temperature at which a first endothermic melting event may begin (i.e. shift from a baseline) on a given DSC trace. Such DSC onset melting temperature of the release agent (wax) herein, suitable to optimize release performance in a given electrophotographic printer, may be equal to or greater than about 40° C. It may also be equal to or greater than about 50° C., 60° C., 70° C., including any temperature up to about 100° C.

The resulting toner particles may also be optimized for performance and characterized by rheological considerations, such as a complex viscosity (η ) between about 500 to 1500 Pa-s at 160° C. and a tan delta value of between about 0.4 to 2.5. Table 2 illustrates exemplary toner particle complex viscosity and tan delta measurements. The measurements were performed at a sinusoidal oscillation frequency of 6.28 rad/s, using a 25 mm sample.

TABLE 2

| Viscosity Measurements | | |
|---|---|---|
| Toner | Complex Viscosity @ 160° C. [Pa · s] | Tan Delta |
| Cyan | 731.8 | 0.736-2.165 |
| Black | 1204.9 | 0.813-2.405 |
| Yellow | 998.8 | 0.824-2.125 |
| Magenta | 1096.3 | 0.455-1.672 |

As noted, inorganic extra particulate additives may then be incorporated with the toner particles as extra particulate additives on the surface of a toner particle. As alluded to above, the extra particulate additives loading may be dependent upon a number of factors, such as the desired softening points of the resin composition. Other factors which may effect the optimized composition of the extra particulate additives include ghosting, halftone print quality, hue, saturation and brightness, which may be measured, for example by the CIE (Commission Internationale d'Eclairage) L*a*b* model, etc. In addition, more functional properties of the toner such as reducing deposits (filming performance) of the toner as it is transferred between components in the image forming apparatus may effect the optimized composition of the extra particulate additives as well.

The inorganic extra particulate additives may include, for example, silicas. The silicas may be fumed or pyrogenic silicas. The silica particles may have a negative tribocharge of less than about −300 μC/g, including all increments and values therein, such as −400 μC/g, −500 μC/g, etc. In addition, the silicas may be surface treated with a hydrophobic agent such as hexamethyldisilazane and/or polydimethylsiloxane. The silica particles may have an agglomerated particle size of less than about 20 microns, and all increments and values therein. Fumed or pyrogenic silicas are available from Dugussa® under the tradename AEROSIL® and Wacker under the tradename HDK® and Cabot under the tradename CAB-O-SIL®.

In an exemplary embodiment, at least two silica species may be utilized having varying specific particle sizes or surface areas. The surface area may be measured by the BET method. For example, relatively small silica particles may be employed having a surface area greater than about 100 $m^2/g$ and/or falling in the range of about 100 $m^2/g$ to 500 $m^2/g$. These relatively small silica particles may be present in the range of about 0. 1-2.0% (wt) of the toner composition.

In addition, relatively larger sized silica particles may be used, in combination with the relatively small silica particles, and may be characterized by a surface area less than about 100 $m^2/g$, including all values and increments therein. For example, the relatively large sized silica particles may fall in the range of about 20 $m^2/g$ to 80 $m^2/g$. These silica particles may be present in the range of greater than about 0.5% (wt), and more specifically, in the range of 0.5-5.0% (wt), including all values and increments therein. For example, the relatively large size silica particles may be present at a level of about 2-3% (wt) of the toner composition.

Acicular inorganic particles may be utilized with the mixture of relatively small and large sized silica particles. The particles may include an inorganic oxide and may have a diameter of between about 0.01 to 10 microns and any increment or value therebetween and a length of between about 1 to 100 microns and any increment or value therebetween. Acicular may be understood as a general reference to a shape wherein one dimension (e.g. length) exceeds another dimension (e.g. width). The particles may specifically be metal particles or metal oxide particles, such as titanium dioxide.

Furthermore, the acicular particles may be surface treated with a reagent. Inorganic reagents may include metal oxides, including for example aluminum oxide, cerium oxide, iron oxide, zirconium oxide, lanthanum oxide, etc. Exemplary particles, such as titanium dioxide particles surface treated with aluminum oxide, may be obtained from Ishihara Corporation, USA, under the trade name FTL and grade 110. Organic reagents may include silicon oxide, hydrophobic polymers or fatty acids. The hydrophobic polymers may include polydimethylsiloxane or hexamethyldisilazane. Fatty acids may include those compositions characterized by the formula $CH_3(CH_2)_nCOOH$, wherein n is in the range of 10-18.

The acicular particles may have a specific gravity of between 3.0 to 6.0 including all increments or values therebetween, such as between 4.0 and 5.0. Furthermore, as measured by the BET method, the acicular particles may have a specific surface area of between 1-30 $m^2/g$ and any value or increment therebetween. The pH of the particles may be between 5-9 and any increment or value therebetween. The particles may also have an electrical resistivity of between approximately $1\times10^6$ ohm-cm to $1\times10^2$ ohm-cm, including all incremental values and ranges therebetween such as $1\times10^8$ ohm-cm. The particles may be present in the range of 0.5-5.0% (wt) including all increments and values therein.

In addition, the acicular inorganic particles may be a mixture of inorganic oxide surface treated particles and inorganic oxide particles that do not contain a metal oxide surface treatment. The inorganic surface treated particles may be present between 1-99% by weight of the acicular particles present and the untreated particles may be present between 1-99% by weight of the acicular particles present including all ranges and increments therein.

Once prepared, the toner particles may be blended with the extra particulate additives (e.g. relatively large size silica particles, relatively small sized silica particles and the acicular inorganic oxide) using a number of blending processes. For example, the toner and extra particulate agents may be placed within a blender. The blender may include a jacketed blender, wherein the temperature of the jacket is maintained between about 10 to 30° C. The toner and extra particulate agent may be pre-mixed between 1 to 40 seconds, including all values and increments therein, at a blending rate of between about 1 to 20 Hertz, including all values and increments therein. The toner and extra particulate agent may then be blended at high rates, wherein the composition may be blended between 50 and 150 seconds, including all values and increments therein, at a rate of between about 20 to 100 Hertz, including all values and increments therein.

Optionally, the toner particles may be mixed with any one or more of the extra particulate additives in a plurality of stages. For example, a portion of any of the EPA disclosed herein may be first combined with toner resin with the initial objective to break-up agglomerates of toner. For example, any one of the above referenced silica particles may be first added at about 0.1% by weight (wt) of the toner composition. The mixing may also occur in a jacketed blender, wherein the jacket is maintained between about 10 to 30° C. The toner and extra particulate additive or additives may therefore be pre-mixed between 1 to 40 seconds, including all values and increments therein, at a blending rate of between about 1 to 20 Hertz, including all values and increments therein. Then the toner and extra particulate additive or additives may be blended at high rates, wherein the composition may be blended between 50 and 150 seconds, including all values and increments therein, at a rate of between about 20 to 100 Hertz, including all values and increments therein.

EXAMPLES

The examples presented herein are merely for purposes of illustration and are not meant to limit the scope of the disclosure and the claims appended hereto.

Example 1

A toner composition containing extra particulate additives is prepared by introducing 15 grams of relatively large silica particles (BET=50+/−20 $m^2/g$), 2.5 grams of relative small silica particles (BET=200+/−30 $m^2/g$) and 5 grams of acicular particles (FTL110) and a sufficient amount of toner to obtain a 500 gram batch (approximately 477.5 grams) into a jacketed blender. The toner has a particle size of about 6 to 7 μm. The relatively large silica particles are available from Wacker Silicones under the trade name HDK®. The small silica particles are available from Wacker Silicones under the trade name HDK®. The acicular particles are available from Ishihara Sangyo Kaisha under the trade name FTL.

Figure 5B:
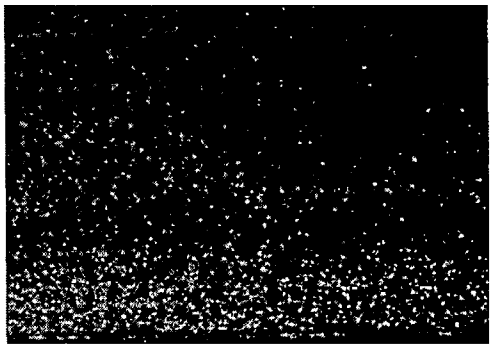
FIG. 5*b* is an embodiment of the present invention illustrating a magnified view of the deposit of toner on a doctor blade at 60° F. and 8% relative humidity, having the same composition as FIG. 5*a*.
Figure 5C:
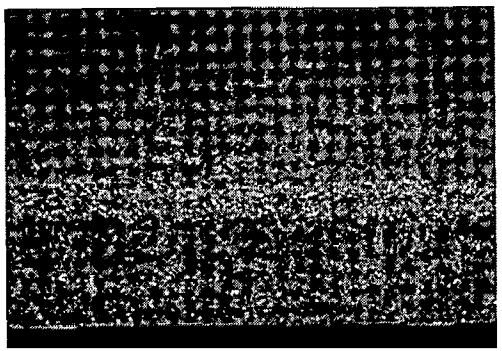
FIG. 5*c* is an embodiment of the present invention illustrating a magnified view of the deposit of toner on a doctor blade at 78° F. and 80% relative humidity, having the same composition as FIG. 5*a*.
Figure 5A:
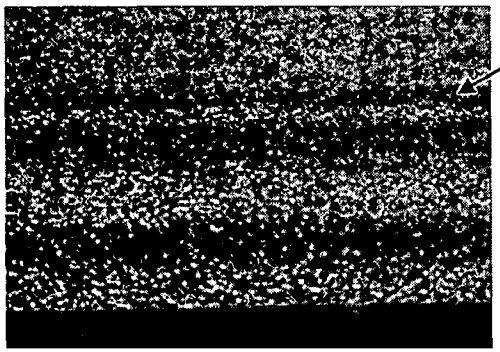
FIG. 5*a* is an embodiment of the present invention illustrating a magnified view of the deposit of toner on a doctor blade at 72° F. and 50% relative humidity.

The toner and extra particulate additives are combined in the blender, wherein the temperature of the jacket may be maintained at about 20° C. The particles may be blended for 20 seconds at 10 Hertz and for 90 seconds at 40 Hertz. The resulting toner composition was tested at various environmental conditions. The results of the testing is illustrated in FIGS. 5*a*, 5*b* and 5*c* depicting the resultant toner deposits found on a doctor blade at ambient temperature, about 72° F. and 50% relative humidity (RH), relatively dry conditions 60° F. and 8% RH, and relatively humid conditions 78° F. and 80% RH, respectively.

Example 2

A toner composition containing extra particulate additives is first prepared by introducing 470 grams of toner into a jacketed blender along with 2.5 grams of relatively small silica particles (BET=260+/−30 $m^2/g$). The blender jacket is maintained at about 20° C. The particles may be blended for 20 seconds at 10 Hertz and then for 90 seconds at 40 Hertz.

Once this has been completed, 15 grams of relatively large silica particles (BET=25-45 $m^2/g$), 2.5 grams of relatively small silica particles (BET=260 +/−30 $m^2/g$) and 10 grams of acicular particles (FTL110) may be added to the blender. The relatively large silica particles are available from Degussa® under the trade name Aerosil®. The relatively small silica particles are available from Degussa® under the trade name Aerosil®. The acicular particles are available from Ishihara Sangyo Kaisha under the trade name FTL.

Figure 6B:
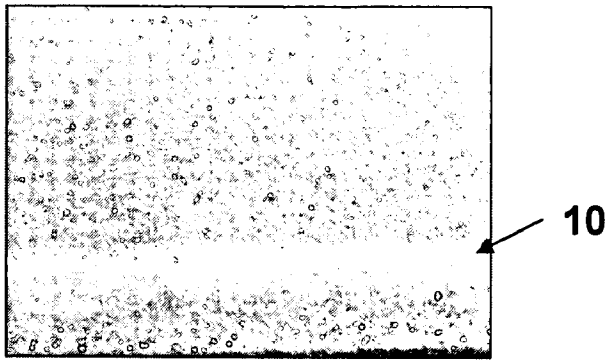
FIG. 6*b* is another embodiment of the present invention illustrating a magnified view of the deposit of toner on a doctor blade at 60° F. and 8% relative humidity, having the same composition as FIG. 6*a*.
Figure 6C:
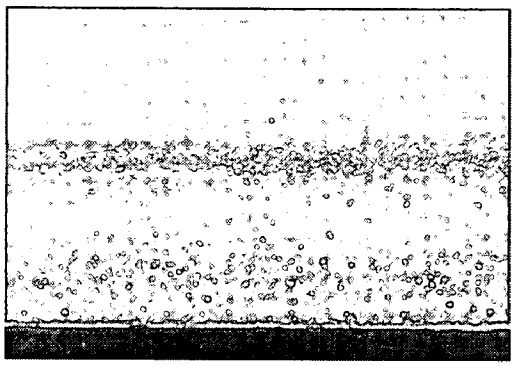
FIG. 6*c* is another embodiment of the present invention illustrating a magnified view of the deposit of toner on a doctor blade at 78° F. and 80% relative humidity, having the same composition as FIG. 6*a*.
Figure 6A:
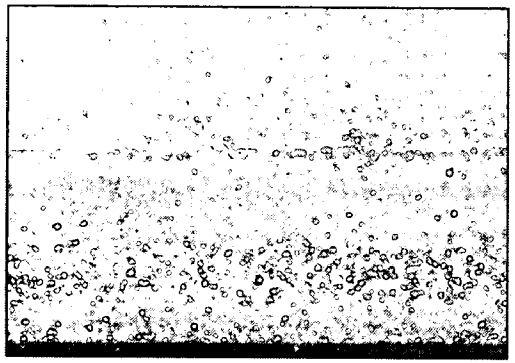
FIG. 6*a* is another embodiment of the present invention illustrating a magnified view of the deposit of toner on a doctor blade at 72° F. and 50% relative humidity.

The toner and extra particulate additives are combined in the jacketed blender, wherein the temperature of the jacket is maintained at about 20° C. The particles may be blended for 20 seconds at 10 Hertz and for 90 seconds at 40 Hertz. The resulting toner composition was tested at various environmental conditions. The results of the testing is illustrated in FIGS. 6*a*, 6*b* and 6*c* depicting the resultant toner deposits found on a doctor blade at ambient temperature (about 72° F. and 50% RH), relatively dry conditions 60° F. and 8% RH, and relatively humid conditions 78° F. and 80% RH, respectively.

Example 3

A toner composition containing extra particulate additives is first prepared by introducing 472.5 grams of toner into a jacketed blender along with 2.5 grams of relatively small silica particles (BET=260+/−30 $m^2/g$). The blender jacket may be maintained at about 20° C. The particles may be blended for 20 seconds at 10 Hertz and then for 90 seconds at 40 Hertz.

Once this has been completed, 15 grams of relatively large silica particles (BET=25-45 $m^2/g$), 5 grams of relatively small silica particles (BET=260+/−30 $m^2/g$) and 5 grams of acicular particles (FTL110) may be added to the blender. The relatively large silica particles are available from Degussa® under the trade name Aerosilμ. The relatively small silica particles are available from Degussa® under the trade name Aerosil®. The acicular particles are available from Ishihara Sangyo Kaisha under the trade name FTL.

The toner and extra particulate agents are combined in the jacketed blender, wherein the temperature of the jacket is maintained at about 20° C. The particles are blended for 20 seconds at 10 Hertz and for 90 seconds at 40 Hertz. The resulting toner composition was tested at various environmental conditions. The results of the testing is illustrated in FIGS. 7*a*, 7*b* and 7*c* depicting the resultant toner deposits found on a doctor blade at ambient temperature (about 72 m° F. and 50% RH), relatively dry conditions 60° F. and 8% RH, and relatively humid conditions 78° F. and 80% RH, respectively.

As can be seen from the above examples and FIGS. 5-7, the extra particulate compositions may influence and be selected to control the deposits that may ultimately occur on a doctor blade within an electrophotographic printer. For example, with respect to FIGS. 5*a*, 5*b* and 5*c*, it can be seen that by combining 0.5% relatively small silica, 3% relatively large silica and 1.0% acicular inorganic oxide particles, the presence of some filming can only be observed on the doctor blade at ambient temperature (72° F. and 50% RH) See item 10 in FIG. 5*a*. In addition, filming has been substantially avoided under relatively dry conditions (60° F. and 8% RH) as well as at relatively humid conditions (78° F. and 80% RH) with acceptable overall print quality.

Turning to FIGS. 6*a*, 6*b* and 6*c*, it can be observed that in this situation, the presence of the largest amount of filming (10) occurs under relatively dry conditions (60° F. and 8% RH) and substantially all filming has been eliminated at ambient temperature (72° F. and 50% RH) and under relatively humid conditions (78° F. and 80% RH). In this evaluation of filming, the relatively small sized silica is present at 1.0% (wt), the relatively large sized silica is present at 3.0% (wt) and the acicular inorganic oxide particles are present at 2.0% (wt), and the overall print quality is acceptable.

Figure 7B:
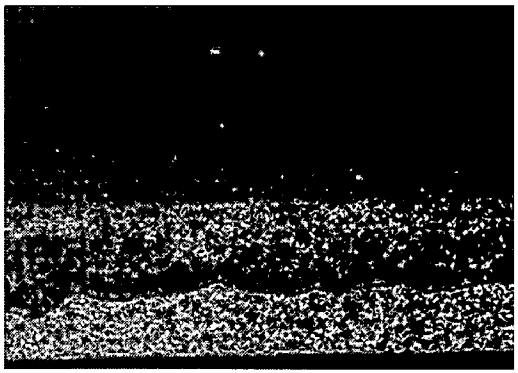
FIG. 7*b* is another embodiment of the present invention illustrating a magnified view of the deposit of toner on a doctor blade at 60° F. and 8% relative humidity, having the same composition as FIG. 7*a*.
Figure 7C:
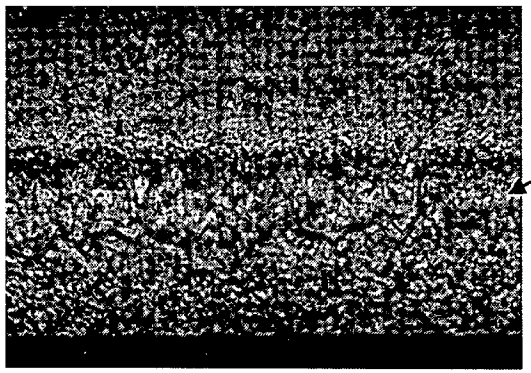
FIG. 7*c* is another embodiment of the present invention illustrating a magnified view of the deposit of toner on a doctor blade at 78° F. and 80% relative humidity, having the same composition as FIG. 7*a*.
Figure 7A:
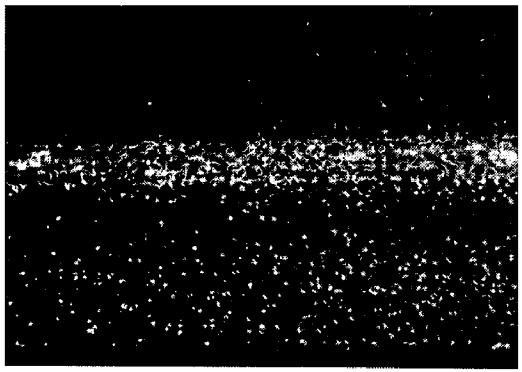
FIG. 7*a* is another embodiment of the present invention illustrating a magnified view of the deposit of toner on a doctor blade at 72° F. and 50% relative humidity.
Figure 8:
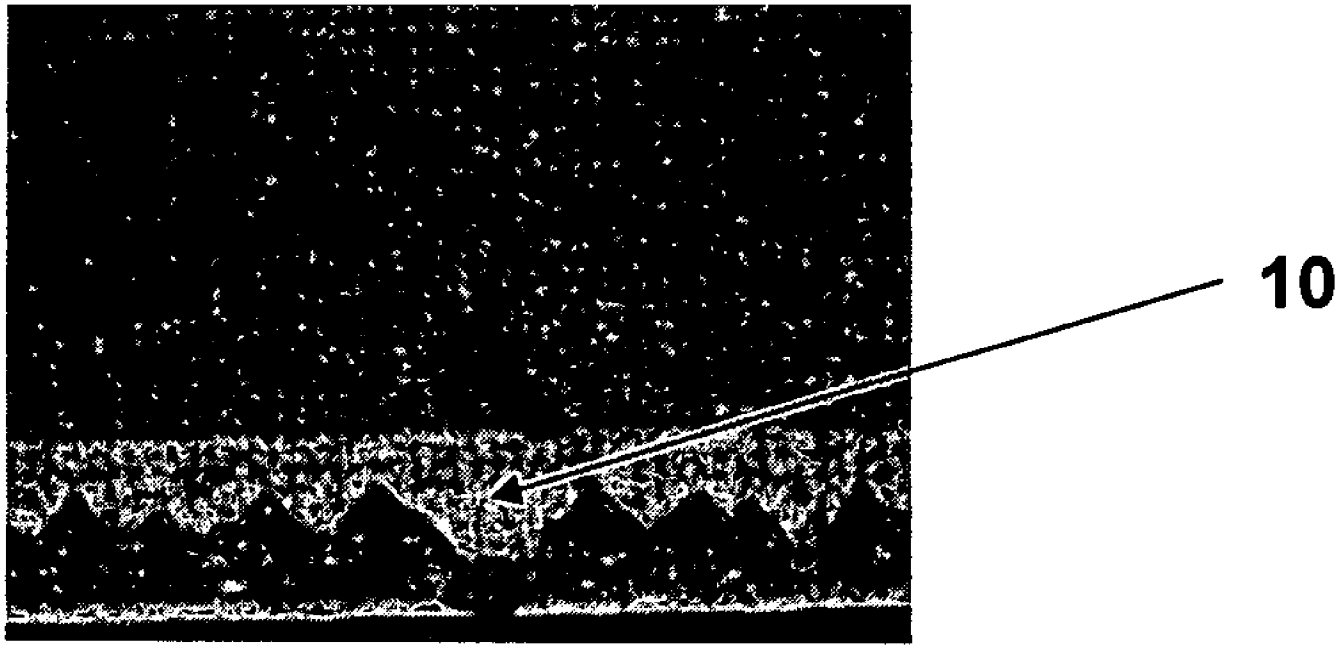
FIG. 8 illustrates a magnified view of filming deposits on a doctor blade.

Turning to FIGS. 7*a*, 7*b* and 7*c*, it can be observed that in this situation, some acceptable level of filming may be controlled and balanced under all conditions of testing, with very good overall print quality. The presence of the largest amount of filming (10) occurs under relatively humid conditions (78° F. and 80% RH), whereas slight degrees of filming are seen at ambient temperature (72° F. and 50% RH) and relatively dry conditions (60° F. and 8% RH). In this evaluation of filming, the relatively small sized silica is present at 1.5% (wt), the relatively large sized silica is present at 3.0% (wt) and the acicular inorganic oxide particles are present at 1.0% (wt), and the overall print quality is again acceptable. By comparison, FIG. 8 illustrates relatively higher level of filming. As can be seen from the figure, a significant degree of buildup (10) has occurred on the doctor blade.

It can therefore be appreciated that by controlling the concentration (e.g. weight percent in the toner) of relatively small sized silica (BET>100 $m^2/g$), relatively large sized silica (BET<100 $m^2/g$) in the presence of acicular inorganic oxide particles, filming can be controlled in an electrophotographic printer. In addition, such control may be applied to the above described CPT type resins, and in particular, those that may have relatively low softening temperatures which may accommodate relatively low energy fuser requirements.

The foregoing description is provided to illustrate and explain the present invention. However, the description hereinabove should not be considered to limit the scope of the invention set forth in the claims appended here to.

What is claimed is:

1. A toner for an image forming apparatus comprising:

a chemically processed toner including a resin having a particle size in the range of 1 micron to 25 microns and particle additive comprising:

(a) silica particles having a BET surface area greater than 100 $m^{2/}g$ which are present in the range of about 0.1 to about 2.0% (wt) of the toner composition, said silica particles having a BET surface area less than 100 $m^{2/}g$ which are present at a level of greater than 0.5% (wt); and (b) acicular inorganic oxide particles present at a level of about 0.5 to about 5.0% (wt) and have a diameter of between about 0.01 to about 10 microns and length of between 1 to 100 microns.

2. The toner of claim 1 wherein said toner particles are present in the range of 1-10 microns in diameter.

3. The toner of claim 1 further comprising a release agent at a concentration greater than 3.0% (wt).

4. The toner of claim 1 further comprising a colorant wherein said colorant is present between about 2-12% (wt.).

5. The toner of claim 1 wherein said resin has a softening point between about 90 to 130° C.

6. The toner of claim 1 wherein said resin comprises a relatively low molecular weight resin and a relatively high molecular weight resin wherein said relatively low molecular weight resin has a Mw of between about 10,000 to 30,000 and said relatively high molecular weight resin comprises a bimodal sample having a Mw of greater than 30,000.

7. The toner of claim 6 wherein said relatively low molecular weight resin is present at greater than 50% (wt) and said relatively high molecular weight resin has a polydispersity index between about 7.1-75.

8. The toner of claim 6 wherein said relatively low molecular weight resin has a polydispersity index between about 1-7 and said relatively high molecular weight resin has a polydispersity index between about 71.-75.

9. The toner of claim 1 wherein said toner comprises a release agent, wherein said release agent has a DSC onset melting temperature of greater than about 4020 C. and a peak melting point temperature of between about 75 to 105° C.

10. The toner of claim 1 wherein said toner has a complex viscosity ($\eta$ ) of between about 500 to 1500 Pa·s.

11. The toner of claim 9 wherein said release agent comprises a mean domain size of between about 0.10 to 1.20μm.

12. A method of controlling filming of a CPT toner having a particle size in the range of about 1-25 microns in an image forming apparatus comprising:

(a) adjusting the concentration of silica particles having a BET surface area>100 $m^{2/}g$ to a concentration between about 0.1-2.0% (wt);

(b) adjusting the concentration of silica particles have a BET surface area of<100 $m^{2/}g$ to a concentration greater than 0.5% (wt);

(c) adjusting the concentration of acicular inorganic oxide particles to a concentration between about 0.5-5.0% (wt).

* * * * *